US009989007B2

(12) United States Patent
Shibata

(10) Patent No.: US 9,989,007 B2
(45) Date of Patent: Jun. 5, 2018

(54) METHOD FOR CONTROLLING VARIABLE OIL PRESSURE TO A PISTON SQUIRTER BASED ON PISTON TEMPERATURE

(71) Applicant: GM GLOBAL TECHNOLOGY OPERATIONS LLC, Detroit, MI (US)

(72) Inventor: Jonathan T Shibata, Whitmore Lake, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 136 days.

(21) Appl. No.: 15/183,117

(22) Filed: Jun. 15, 2016

(65) Prior Publication Data

US 2017/0363039 A1 Dec. 21, 2017

(51) Int. Cl.
*F02F 3/22* (2006.01)
*F01M 1/16* (2006.01)

(52) U.S. Cl.
CPC ..... *F02F 3/22* (2013.01); *F01M 1/16* (2013.01)

(58) Field of Classification Search
CPC ..... F02F 3/22; F02F 3/20; F02F 3/16; F02F 3/02; F01M 1/16; F01M 1/08; F01M 2001/083
See application file for complete search history.

(56) References Cited

U.S. PATENT DOCUMENTS 8,989,989 B2 * 3/2015 Sczomak ..... F02D 41/401 123/689
2014/0100765 A1 * 4/2014 Maki ..... F01P 3/08 701/113

* cited by examiner

*Primary Examiner* — Jacob Amick

(57) ABSTRACT

A method for controlling variable oil pressure to a piston squirter based on piston temperature according to an exemplary embodiment includes a temperature estimation module and an oil pump pressure control module. The temperature estimation module estimates a piston temperature associated with a cylinder based on engine operating conditions. The oil pump pressure control module controls the oil pressure level delivered to at least one of piston squirter associated with the cylinder to selectively spray oil on the piston based on temperature estimations.

18 Claims, 4 Drawing Sheets

METHOD FOR CONTROLLING VARIABLE OIL PRESSURE TO A PISTON SQUIRTER BASED ON PISTON TEMPERATURE

FIELD

The present disclosure relates to methods for controlling variable oil pressure to a piston squirter based on piston temperature.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. Air flow into the engine is regulated via a throttle valve, which adjusts a throttle area to control air flow into the engine. A fuel control system adjusts the rate that fuel is injected to provide a desired air/fuel mixture to the cylinders and/or to achieve a desired torque output. Increasing the amount of air and fuel provided to the cylinders increases the torque output of the engine.

In spark-ignition engines, spark initiates combustion of an air/fuel mixture provided to the cylinders. In compression-ignition engines, compression in the cylinders combusts the air/fuel mixture provided to the cylinders.

During the combustion process, the temperature of the piston increases significantly. Methods used to cool the piston may include enriching the air/fuel mixture and/or adding piston squirters. Piston squirters spray oil at a skirt of the piston.

SUMMARY

A method according to an aspect of an exemplary embodiment includes estimating a piston temperature associated with an engine cylinder based on engine operating conditions. An oil pressure control module is operable for determining if the estimated piston temperature is greater than a predetermined hot temperature threshold. The oil pressure control module is further operable for controlling an oil pump pressure to at least one piston squirter associated with the cylinder to cause the at least one piston squirter to activate if the estimated piston temperature is greater than the predetermined hot temperature threshold.

Further areas of applicability of aspects of the exemplary embodiment will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
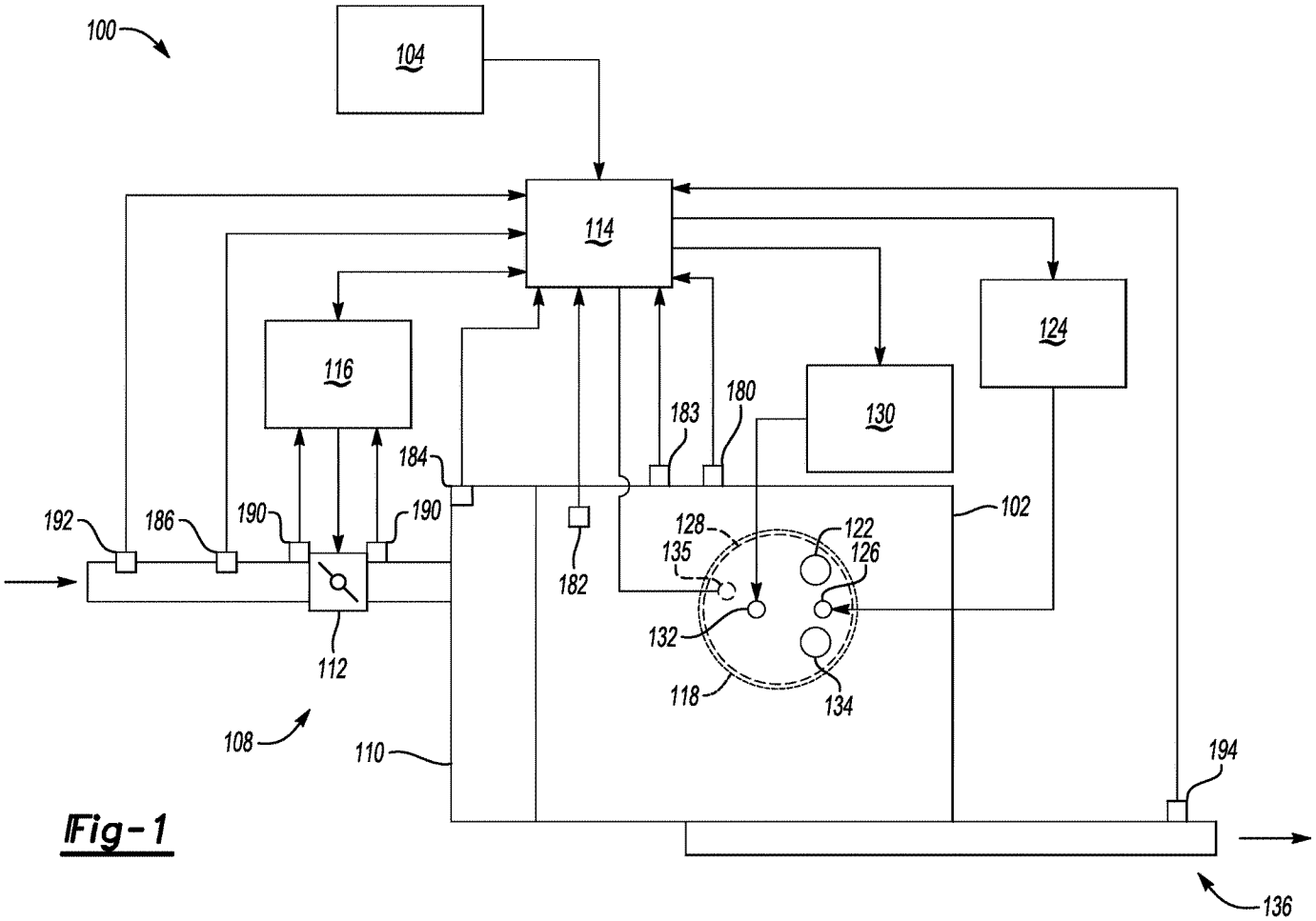
FIG. 1 is a functional block diagram of an example engine system according to aspects of an exemplary embodiment.

During operation of the engine, frictional forces attributable to continuously moving parts may promote unintended wear, fatigue, and/or degradation. To combat this operating friction, the engine may include a lubrication system (not shown), which may include an oil pump pressure control module, an oil pump in fluid communication with an oil reservoir, and at least one piston squirter. In one configuration, the oil pump may be an electrically operated pump that may be controllably operated by a control module in accordance with aspects of an exemplary embodiment. Preferably, an engine control module (ECM) is operable as the oil pump pressure control module but it is appreciated that the oil pump pressure control module can be a separate unit dedicated to controlling pressure to the at least one piston squirter. In another configuration, the oil pump may be a mechanical pump that may be selectively drivable by a rotational output of the engine.

The oil reservoir may be partially defined by the oil pan and may contain an engine oil, such as a petroleum-based or synthetic-based oil. The oil pump may draw engine oil from the oil reservoir, pressurize it, and supply it to various moving components within the engine to lubricate and/or cool those components.

As is common in combustion engines, and in accordance with aspects of an exemplary embodiment, the oil pump supplies oil to at least one piston squirter, where the oil may be operative to directly lubricate and/or cool the piston. In turn, the oil pump is controlled by the oil pump pressure control module that is operable to control the pressure required by the oil pump to activate the at least one piston squirter.

As may be appreciated, the primary heat source within the engine is the combustion chamber, where fuel is continuously burned. During periods of extreme and/or prolonged usage, the piston and cylinder may accumulate thermal energy faster than it can be dissipated using traditional engine cooling systems. This heat accumulation problem is further accentuated in high-compression engines, which force an increased amount of air/fuel into the combustion chamber with every combustion cycle.

Piston squirters are useful in cooling the piston by spraying its underside with the (comparatively cooler) engine oil. During periods of lighter use, however, the use of piston squirters may be less beneficial, with any marginal cooling and/or lubrication benefits being generally offset by parasitic efficiency losses attributable to the increased oil flow/pumping. Likewise, in certain circumstances, such as low-temperature cold-engine starts, the cooling effect may even be undesirable if the goal is to actively warm the engine to an ideal operating temperature. When the piston temperature is less than a predetermined piston temperature threshold, fuel puddles form on piston surfaces. Preventing fuel puddles from forming on piston surfaces in an engine reduces the amount of particulate matter produced by the engine. Preventing fuel puddles from forming on piston surfaces may also prevent other negative effects such as oil dilution.

A method according to aspects of an exemplary embodiment controls variable oil pressure to at least one piston squirter associated with an engine cylinder based on an estimated piston temperature. Referring now to FIG. 1, a functional block diagram of an example engine system 100 is presented. The engine system 100 includes an engine 102 that combusts an air/fuel mixture to produce drive torque for a vehicle based on driver input from a driver input module 104. The driver input module 104 includes an accelerator pedal position and/or a cruise control setting (not shown). The cruise control setting is received from a cruise control system, which may be an adaptive cruise control system that varies vehicle speed to maintain a predetermined following distance.

Air is drawn into the engine 102 through an intake system 108. The intake system 108 includes an intake manifold 110 and a throttle valve 112, which may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 2, 3, 4, 5, 6, 8, 10, and/or 12 cylinders. The ECM 114 may deactivate some of the cylinders, which may improve fuel economy under certain engine operating conditions.

The engine 102 may operate using a four-stroke cycle. The four strokes, described below, are named the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates a fuel injector 126 to achieve a desired air/fuel ratio. As presently shown, the fuel injector 126 injects fuel directly into the cylinders. Additionally or alternatively, fuel may be injected into mixing chambers associated with the cylinders. Additionally, fuel may be injected into the intake manifold 110 at a central location or at multiple locations, such as near the intake valve 122 of each of the cylinders. The fuel actuator module 124 may halt injection of fuel to cylinders that are deactivated.

During the compression stroke, a piston 128 within the cylinder 118 compresses the air/fuel mixture. At least one piston squirter (not shown) is disposed adjacent the underside of the piston for spraying oil on the piston. It is appreciated that it is not desirable to allow oil to enter the combustion chamber along with the air/fuel mixture thus spraying the oil on the underside of the piston will minimize risk associated with such occurrences.

The engine 102 may be a compression-ignition engine, in which case compression in the cylinder 118 ignites the air/fuel mixture. Alternatively, the engine 102 may be a spark-ignition engine (e.g., a spark ignition direct injection (SIDI) engine), in which case a spark actuator module 130 energizes a spark plug 132 in the cylinder 118 based on a signal from the ECM 114, which ignites the air/fuel mixture. The timing of the spark may be specified relative to the time when the piston is at its topmost position, referred to as top dead center (TDC).

The spark actuator module 130 may be controlled by a timing signal specifying how far before or after TDC to generate the spark. Because piston position is directly related to crankshaft rotation, operation of the spark actuator module 130 may be synchronized with crankshaft angle. In various implementations, the spark actuator module 130 may halt provision of spark to deactivated cylinders.

Generating the spark may be referred to as a firing event. The spark actuator module 130 may have the ability to vary the timing of the spark for each firing event. The spark actuator module 130 may even be capable of varying the spark timing for a next firing event when the spark timing signal is changed between a last firing event and the next firing event. In various implementations, the engine 102 may include multiple cylinders and the spark actuator module 130 may vary the spark timing relative to TDC by the same amount for all cylinders in the engine 102.

During the combustion stroke, the combustion of the air/fuel mixture drives the piston down, thereby driving the crankshaft. The combustion stroke may be defined as the time between the piston reaching TDC and the time at which the piston returns to bottom dead center (BDC). During the exhaust stroke, the piston begins moving up from BDC and expels the byproducts of combustion through an exhaust valve 134. The byproducts of combustion are exhausted from the vehicle via an exhaust system 136.

The engine system 100 may measure the position of the crankshaft using a crankshaft position (CKP) sensor 180. In accordance with aspects of an exemplary embodiment, the CKP sensor 180 is also used to determine engine speed. The temperature of the engine coolant may be measured using an engine coolant temperature (ECT) sensor 182. The ECT sensor 182 may be located within the engine 102 or at other locations where the coolant is circulated, such as a radiator (not shown). An oil pressure sensor 183 located on the engine 102 and is used for measuring the engine oil pressure and sending the measurement to the ECM 114. The oil pressure sensor 183 may also be located near the output of the oil pump (not shown) for measuring oil pressure.

The pressure within the intake manifold 110 is measured using a manifold absolute pressure (MAP) sensor 184. In various implementations, engine vacuum, which is the difference between ambient air pressure and the pressure within the intake manifold 110, may be measured. The mass flow rate of air flowing into the intake manifold 110 is measured using a mass air flow (MAF) sensor 186. In various implementations, the MAF sensor 186 may be located in a housing that also includes the throttle valve 112.

The throttle actuator module 116 monitors the position of the throttle valve 112 using one or more throttle position sensors (TPS) 190. The ambient temperature of air being drawn into the engine 102 is measured using an intake air temperature (IAT) sensor 192. The air/fuel ratio of exhaust gas output by the engine 102 is measured using an air/fuel ratio (AFR) sensor 194. The ECM 114 uses signals from the sensors to make control decisions for the engine 100. For example, the ECM 114 estimates a piston temperature and adjusts injection timing, injection pressure, injection location, and/or a number of injections per engine cycle based on the piston temperature. In accordance with aspects of the exemplary embodiments, the ECM 114 is operable to the control the spraying of the piston squirters.

Figure 2:
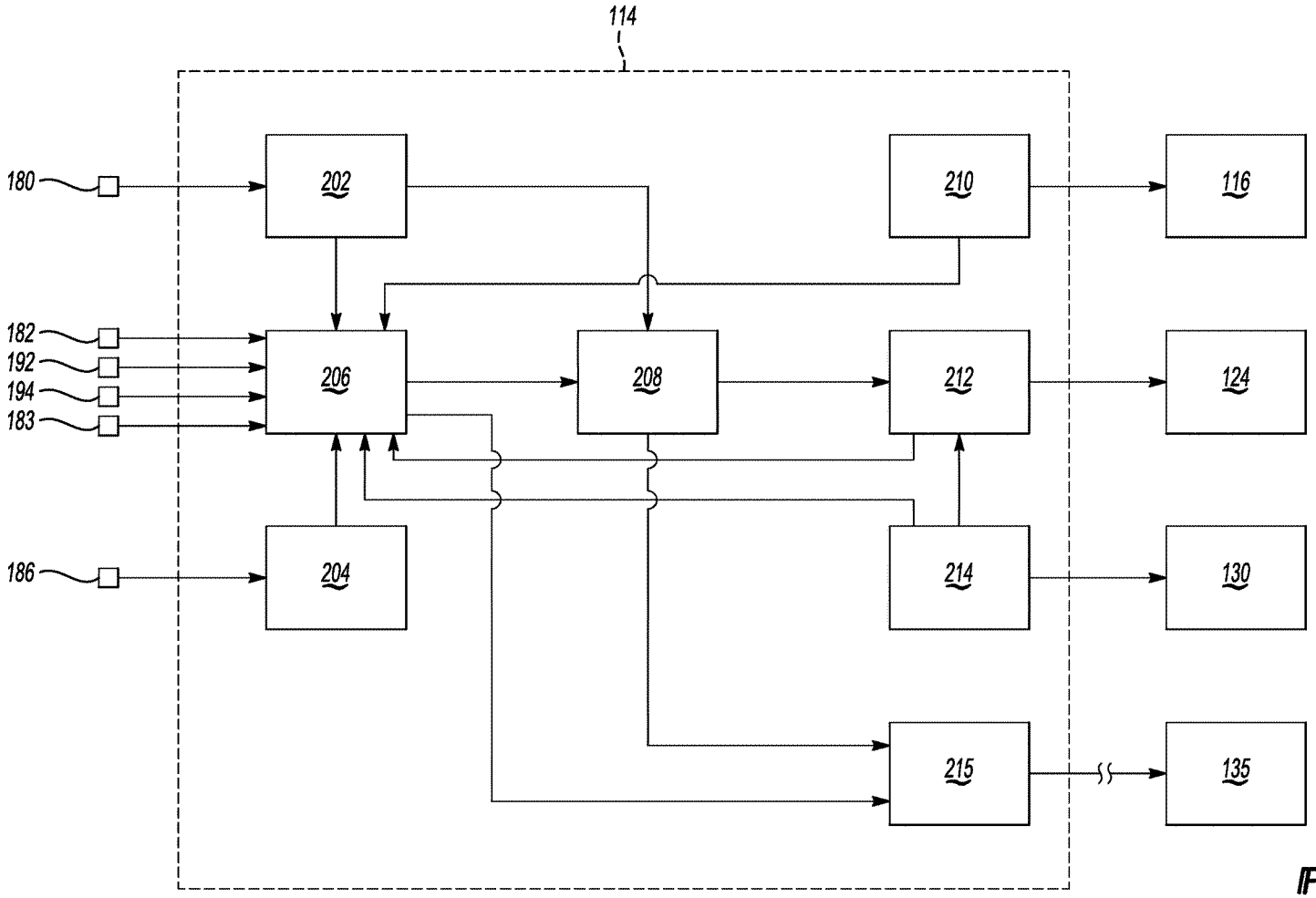
FIG. 2 is a functional block diagram of an example engine control system according to further aspects of an exemplary embodiment.

Referring now to FIG. 2, an example implementation of the ECM 114 includes a speed determination module 202, a load determination module 204, a temperature estimation module 206, and a temperature filter module 208. The speed determination module 202 determines the engine speed based on input from the CKP sensor 180. For example, the speed determination module 202 may calculate the engine speed based on a period that elapses as the crankshaft completes one or more revolutions. The speed determination module 202 outputs the engine speed.

The load determination module 204 determines the engine load based on input from the MAF sensor 186. The load determination module 204 may determine an amount of airflow per cylinder based on the mass flow rate of air and the number of cylinders in the engine 102. The engine load may be directly proportional to the amount of airflow per cylinder. The load determination module 204 outputs the engine load.

The temperature estimation module 206 estimates a piston temperature based on engine operating parameters. The engine operating parameters may include the engine speed, the engine load, the intake air temperature, the engine coolant temperature, oil pressure, air per cylinder, an air/fuel ratio, and/or spark timing. In accordance with an exemplary embodiment, the engine operating conditions are engine speed, engine coolant temperature, oil pressure, and air cylinder pressure. If a cylinder is deactivated then the engine operating conditions used to estimate the piston temperature are engine coolant temperature and a predetermined offset value to accurately model heat generated by friction. The air/fuel ratio and/or the spark timing may be associated with all of the cylinders in the engine 102 and/or the single cylinder with which the piston temperature is associated.

The temperature estimation module 206 may receive the air/fuel ratio from the AFR sensor 194. Additionally or alternatively, the temperature estimation module 206 may determine the air/fuel ratio based on input received from a throttle control module 210 and a fuel control module 212. The input received may include a desired throttle area and a desired pulse width. The temperature estimation module 206 determines the spark timing based on input received from a spark control module 214. The input received may include a desired spark timing. An oil pump pressure control module 215 controls the pressure level delivered to the at least one piston squirter 135. In accordance with an aspect of an exemplary embodiment, if the oil pump pressure control module 215 causes the pressure level to the at least one piston squirter 135 to increase then oil is sprayed on the underside of the piston 128. If the oil pump pressure control module 215 causes the pressure level to the at least one piston squirter 135 to decrease then no oil is sprayed on the piston 128.

The temperature estimation module 206 may estimate the piston temperature based on the engine operating conditions using a predetermined relationship. The predetermined relationship may be embodied in a mathematical model and/or a lookup table. The predetermined relationship may apply weight factors to the engine operating conditions. The weight factors applied to some of the engine operating conditions (e.g., engine speed, engine load, air/fuel ratio) may be greater than the weight factors applied to the other engine operating conditions (e.g., intake air temperature, spark timing).

The predetermined relationship may be developed when the engine 102 is operating in steady-state conditions. The engine 102 may operate in steady-state conditions when the engine 102 is warm (e.g., at an operating temperature) and/or is operating at a relatively constant speed. The piston temperature that is estimated using the predetermined relationship may be referred to as a steady-state temperature. The temperature estimation module 206 outputs the steady-state piston temperature.

The temperature filter module 208 filters the piston temperature using a lag filter to account for the engine 102 operating in transient conditions. The engine 102 may operate in transient conditions when the engine 102 is cold (e.g., at a temperature that is less than the operating temperature) and/or when the engine 102 is rapidly accelerating or decelerating. When the engine 102 operates in transient conditions, the piston temperature may not change as rapidly as the engine operating conditions change. Thus, the lag filter may be used to account for differences between a change rate of the piston temperature and change rate(s) of the engine operating conditions. The filtered piston temperature may be referred to as a transient temperature.

The temperature filter module 208 may filter the piston temperature using a first order lag filter. For example, the temperature filter module 208 may determine the filtered piston temperature $(T_f)$pres in a present iteration using the following equation:

$$(T_f)_{pres}=(T_f)_{prev}+k*[(T_{ss})_{pres}-(T_f)_{prev})] \quad (1)$$

where $(T_f)_{prev}$ is a filtered temperature determined in a previous iteration, k is a constant, and $(T_{ss})_{pres}$ is the steady-state temperature determined in the present iteration. The constant k may be a predetermined value between zero and one, inclusive.

The lag filter may be developed through modeling, testing, and/or calibration. The lag filter may be adjusted based on operating conditions of the engine 102. For example, the constant k may be adjusted based on the engine speed and/or an iteration loop rate of the ECM 114. In various implementations, the constant k is directly proportional to the engine speed and the iteration loop rate of the ECM 114. The temperature filter module 208 outputs the piston temperature as filtered.

The fuel control module 212 controls injection timing, injection pressure, injection location, and/or a number of injections per engine cycle based on the piston temperature. The fuel control module 212 may retard the injection timing, adjust the injection pressure, adjust the injection location, and/or command multiple injections per engine cycle when the piston temperature is less than a temperature threshold. The fuel control module 212 may adjust the injection location by switching from injecting fuel via port injection and direct injection to injecting fuel via port injection only. The fuel control module 212 may stop retarding the injection timing, inject fuel via direct injection, and/or command a single injection per engine cycle when the piston temperature is greater than the temperature threshold.

The fuel control module 212 outputs a desired pulse width. The fuel control module 212 may determine a desired pulse width based on a driver torque request, which may be determined based on the driver input. When the fuel control module 212 commands multiple injections per engine cycle, the fuel control module 212 may divide the desired pulse width by the number of injections to obtain a pulse width per injection.

The fuel control module 212 also outputs a desired crank angle, which is a crank angle corresponding to a time when a start of injection is desired. The fuel control module 212 may adjust the desired crank angle to inject fuel into the cylinder 118 when the piston 128 is completing an intake stroke. Thus, the desired crank angle may be specified in number of degrees before TDC. When the fuel control module 212 retards the injection timing, the fuel control module 212 may decrease the desired crank angle to delay the start of injection.

The throttle control module 210 instructs the throttle actuator module 116 to regulate the throttle valve 112 based on the desired throttle area. The fuel control module 212 instructs the fuel actuator module 124 to regulate the fuel injector 126 based on the desired pulse width and the desired crank angle. The spark control module 214 instructs the spark actuator module 130 to regulate the spark plug 132 based on the desired spark timing. The oil pump pressure control module 215 is in communication with the temperature estimation module 206 and the temperature filter module 208 to determine when to increase or decrease oil pressure delivered to the at least one piston squirter 135.

In accordance with aspects of an exemplary embodiment, the oil pump pressure control module 215 increases pressure delivered to the at least one piston squirter 135 when the estimated piston temperature is greater than a predetermined hot temperature threshold and decreases pressure to the at least one piston squirter 135 when the estimated piston temperature does not exceed the predetermined hot temperature threshold. As such, the at least one piston squirter 135 only sprays the piston 128 when the estimated temperature exceeds the predetermined temperature threshold and needs to be cooled as opposed to a predetermined cooling schedule or look up table thresholds. Accordingly, the engine work load from activating the at least one piston squirter 135 is effectively reduced which results in increased fuel economy.

Figure 3:
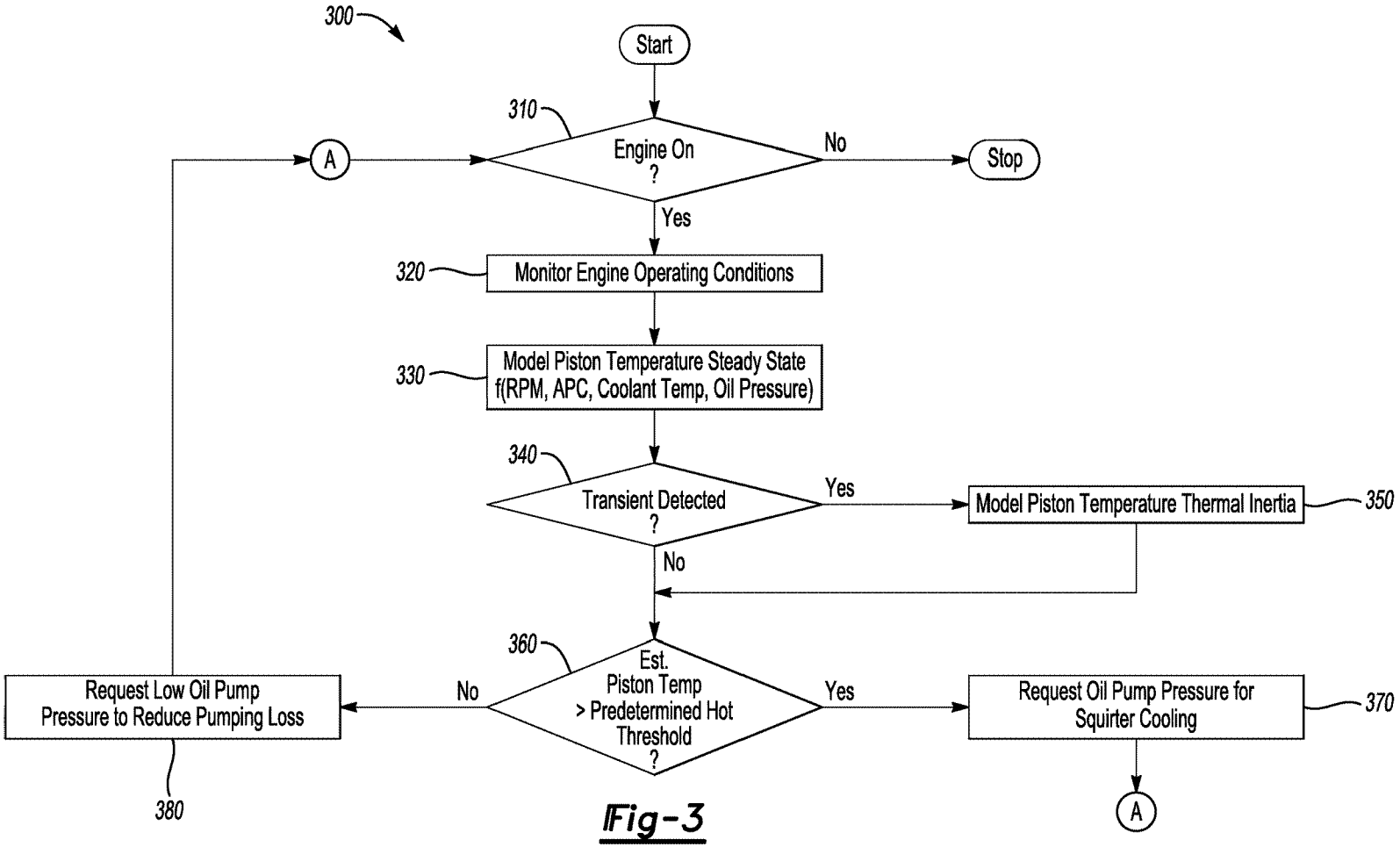
FIG. 3 is a flowchart illustrating an example engine control method according to aspects of an exemplary embodiment.

Referring now to FIG. 3, a method 300 for controlling variable oil pressure to a piston squirter based on piston temperature. At block 310, the method begins with the ECM 114 determining if the engine 102 is on. If the ECM 114 determines that the engine 102 is on then at block 320 the ECM begins monitoring the engine 114 operating conditions. In accordance with aspects of an exemplary embodiment, the ECM 114 monitors the crankshaft position sensor 180 to determine the engine speed, the engine coolant temperature sensor 182 to determine the engine coolant temperature, the oil pressure sensor 183 to determine the oil pressure, and the MAF sensor 186 to determine the an air per cylinder value. These engine operating conditions are used by the temperature estimation module 206 and the temperature filter module 208 to determine the estimated piston temperature.

At block 330, the temperature estimation module 206 determines the estimated piston temperature based on mathematical model using the engine operating conditions sensed by the CKP sensor 180, ECT sensor 182, the oil pressure sensor 183 and the MAF sensor 186.

At block 340, the ECM determines if an engine transient condition is occurring. If a transient condition is detected then, at block 350, the temperature filter module 208 adjusts the estimated piston temperature based on a mathematical model for determining the thermal inertia of the piston 128. This mathematical model may account for, but not limited to, the piston mass, thermal history, and various engine operating conditions. After the temperature filter module 208 adjusts the estimated piston temperature calculated by the temperature estimation module 206 then the method continues to block 360. Also, if a transient condition is not detected then the method continues at block 360.

At block 360, the oil pressure control module 215 determines if the estimated piston temperature is greater than a predetermined hot temperature threshold. If the oil pump pressure control module 215 determines that the estimated piston temperature is greater than the predetermined hot temperature threshold then, at block 370, the oil pump pressure control module controls the oil pressure level delivered to the at least one piston squirter 135 to increase and oil is sprayed on the underside of the piston 128 for cooling. If the oil pump pressure control module 215 determines that the estimated piston temperature is less than the predetermined hot temperature threshold then, at block 380, the oil pump pressure control module 215 controls the oil pressure level delivered to the piston squirter 135 to decrease such that no oil is sprayed on the piston 128. From block 370 and block 380, the method repeats at block 310 until the engine 102 is off.

Figure 4:
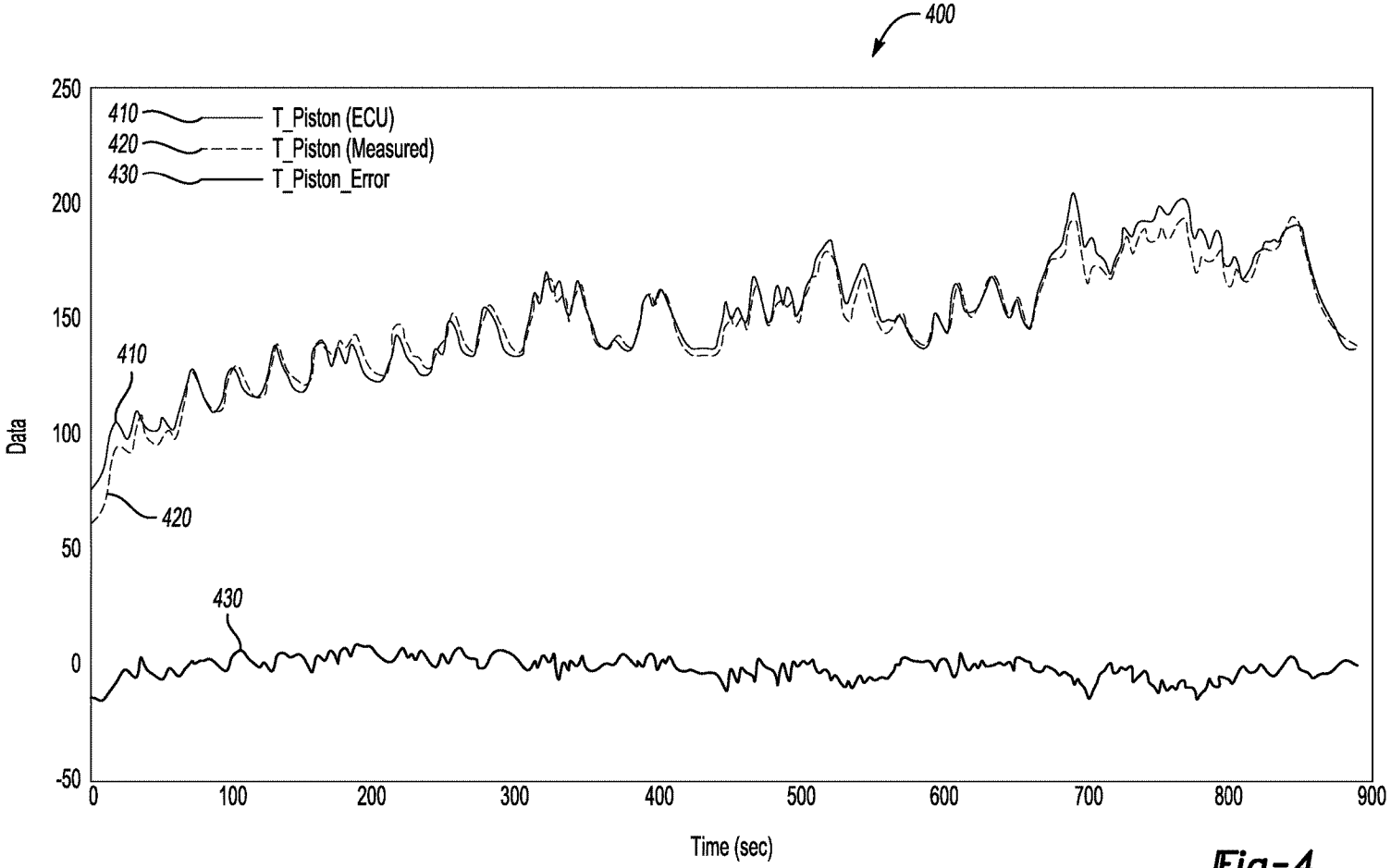
FIG. 4 is a graph illustrating a plot of the measured piston temperature, estimated piston temperature and the temperature error between the measured and the estimated temperature in accordance with aspects of an exemplary embodiment.

Referring now to FIG. 4, a graph 400 illustrating a plot of the measured piston temperature, estimated piston temperature and the temperature error between the measured and the estimated temperature in accordance with aspects of an exemplary embodiment. The x-axis is for (Time) in seconds and the y-axis is (Temperature) in Celsius. As illustrated, the estimated piston temperature 410 and the measured piston temperature 420 track very closely as can be verified by the relative piston temperature error 430. It is appreciate that the real time piston temperature estimation module allows for optimization of mitigation strategies for selectively cooling the pistons as opposed to cooling strategies based on predetermined schedules.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

What is claimed is:

1. A method comprising:

estimating a piston temperature based on engine coolant temperature and a predetermined offset value when the cylinder is deactivated;

determining if the estimated piston temperature is greater than a predetermined hot temperature threshold; and controlling an oil pump pressure to at least one piston squirter associated with the cylinder to cause the at least one piston squirter to activate if the estimated piston temperature is greater than the predetermined hot temperature threshold.

2. The method of claim 1 further comprising estimating the piston temperature based on a predetermined thermal inertia of the piston.

3. The method of claim 1 wherein controlling the oil pump pressure further comprises increasing the oil pump pressure to the at least one oil squirter if the estimated piston temperature is greater than the predetermined hot temperature threshold.

4. The method of claim 1 wherein controlling the oil pump pressure further comprises decreasing oil pump pressure to the at least one oil squirter if the estimated piston temperature is less than predetermined hot temperature threshold.

5. The method of claim 1 further comprising estimating a piston temperature based on engine operating conditions including engine speed, engine oil pressure, air per cylinder, and engine coolant temperature.

6. The method of claim 5 further comprising estimating the piston temperature based on high engine oil pressure.

7. The method of claim 5 further comprising estimating the piston temperature based on low engine oil pressure.

8. The method of claim 1 further comprising filtering the piston temperature using a lag filter.

9. The method of claim 8 wherein the lag filter is a first order lag filter.

10. The method of claim 8 further comprising adjusting the lag filter based on at least one of engine speed and an iteration loop rate.

11. The method of claim 10 wherein the piston temperature is adjusted at a first rate that is directly proportional to the at least one of the engine speed and the iteration loop rate.

12. A system comprising:

a temperature estimation module that estimates a piston temperature associated with a cylinder based on engine operating conditions wherein the temperature estimation module estimates the piston temperature of a deactivated cylinder based on engine coolant temperature and a predetermined offset value;

at one piston squirter associated with the cylinder; and an oil pressure control module that controls pressure to the at least one piston squirter, the oil pressure control module being operable to activate the at least one piston squirter if the estimated piston temperature is greater than a predetermined hot temperature threshold.

13. The system of claim 12 wherein the oil pressure control module increases the oil pump pressure to the at least one oil squirter if the estimated piston temperature is greater than the predetermined hot temperature threshold.

14. The system of claim 12 wherein the oil pressure control module decreases the oil pump pressure to the at least one oil squirter if the estimated piston temperature is less than the predetermined hot temperature threshold.

15. The system of claim 12 wherein the temperature estimation module estimates the piston temperature based on engine operating conditions including engine speed, engine oil pressure, air per cylinder, and engine coolant temperature.

16. The system of claim 12 wherein the temperature estimation module estimates the piston temperature further based on a predetermined thermal inertia of the piston.

17. The system of claim 12 further comprising a temperature filter module that filters the piston temperature using a lag filter.

18. The system of claim 17 wherein the lag filter is a first order lag filter.

* * * * *